US009555619B2

(12) United States Patent
Pertile et al.

(10) Patent No.: US 9,555,619 B2
(45) Date of Patent: Jan. 31, 2017

(54) ANILOX ROLLER, PARTICULARLY FOR FLEXOGRAPHIC PRINTING MACHINES

(75) Inventors: Agostino Pertile, San Martino Buon Albergo (IT); Luigi Bertagna, Verona (IT)

(73) Assignee: UTECO CONVERTING S.P.A., Colognola Ai Colli (IT)

( * ) Notice: Subject to any disclaimer, the term of this patent is extended or adjusted under 35 U.S.C. 154(b) by 250 days.

(21) Appl. No.: 13/137,708

(22) Filed: Sep. 7, 2011

(65) Prior Publication Data

US 2012/0055359 A1 Mar. 8, 2012

(51) Int. Cl.

| | |
|---|---|
| ***B41F 13/10*** | (2006.01) |
| ***B41F 31/00*** | (2006.01) |
| ***B41F 27/10*** | (2006.01) |
| ***B41F 27/12*** | (2006.01) |
| ***B41F 31/02*** | (2006.01) |
| ***B41F 31/26*** | (2006.01) |

(52) U.S. Cl.

CPC ..... *B41F 31/002* (2013.01); *B41F 27/105* (2013.01); *B41F 27/1212* (2013.01); *B41F 31/027* (2013.01); *B41F 31/26* (2013.01)

(58) Field of Classification Search

CPC .. B21B 27/08; B21B 27/083; B21B 2027/083; B21B 2027/086; F28F 5/02; B41F 27/105; B41F 27/1212; B41F 31/027; B41F 31/26

USPC ..... 101/183, 487, 216, 153, 178, 174, 141, 101/375

See application file for complete search history.

(56) References Cited

U.S. PATENT DOCUMENTS

| | | | | |
|---|---|---|---|---|
| 3,187,809 | A * | 6/1965 | Spears | D06C 15/08 165/168 |
| 4,140,337 | A * | 2/1979 | Arcella et al. | 285/3 |
| 5,134,936 | A | 8/1992 | John | |
| 5,233,921 | A | 8/1993 | John | |
| 5,292,298 | A * | 3/1994 | Scannell | 492/46 |
| 5,941,808 | A | 8/1999 | Oder | |
| 5,974,817 | A * | 11/1999 | Prummer | 62/238.6 |
| 6,006,665 | A | 12/1999 | Stuchlik et al. | |
| 6,615,716 | B1 | 9/2003 | Freddo et al. | |
| 6,810,800 | B1 * | 11/2004 | Schneider et al. | 101/217 |
| 6,868,782 | B2 | 3/2005 | Dauner | |
| 6,874,415 | B2 * | 4/2005 | Hoffmann et al. | 101/217 |
| 7,389,728 | B2 * | 6/2008 | Hieronymus et al. | 101/479 |
| 2003/0134732 | A1 | 7/2003 | Kolbe et al. | |

FOREIGN PATENT DOCUMENTS

| | | |
|---|---|---|
| EP | 0 428 893 A2 | 5/1991 |
| JP | S61-189995 | 8/1986 |
| WO | WO 99/22937 A1 | 5/1999 |

* cited by examiner

*Primary Examiner* — Matthew G Marini

(74) *Attorney, Agent, or Firm* — Modiano & Associati; Daniel J. O'Byrne

(57) ABSTRACT

An anilox roller for flexographic printing machines, which comprises a sleeve cylinder rotatably supported about its own axis by the fixed structure of a flexographic printing machine, and an anilox sleeve, which has a tubular body provided, on its outer side wall, with an anilox surface which can be axially fitted on and removed from the sleeve cylinder. Forced circulation of a temperature control fluid within the tubular body is further provided.

5 Claims, 6 Drawing Sheets

ANILOX ROLLER, PARTICULARLY FOR FLEXOGRAPHIC PRINTING MACHINES

The present invention relates to an anilox roller, particularly for flexographic printing machines.

BACKGROUND OF THE INVENTION

As is known, in printing machines the transfer of ink to the material to be printed on is basically achieved via three cylinders: an anilox roller, a plate roller and an impression roller.

Specifically, the function of the anilox roller is to ink the plate, which is carried by the plate roller, which in turn prints on the material, which is carried by the impression roller.

Typically, the anilox roller has a lateral anilox surface, that is to say it is provided with a plurality of cells that are open outward, inside which the ink is deposited via an inking device, known in the printing trade as a closed chamber doctor blade.

It should be noted that, for practical reasons when changing the print format, in most flexographic printing machines the anilox roller, instead of being constituted by an integral anilox roller, is now implemented by means of a sleeve cylinder upon which an anilox sleeve can be fitted and from which the anilox sleeve can be removed which is, in practice, constituted by a tubular body provided with an outer anilox lateral surface.

In general, the inking device associated with each anilox roller goes from an inking chamber, which is open toward the lateral surface of the anilox roller and is supplied with ink under pressure so that the ink fills the cells of the anilox roller. On mutually opposite longitudinal sides of the inking chamber, two doctor blades are situated which scrape the excess ink off the cells of the anilox roller.

The friction between the doctor blades and the surface of the rotating anilox roller generates heat.

For solvent-based or water-based inks, the heat produced causes the evaporation of the solvent or of the water in sufficient measure to keep the temperature of the ink and of the anilox roller substantially at ambient temperature.

For UV and EB-type inks (that is to say, inks that can be dried using ultraviolet rays or electron beams), which, as is known, are much more viscous than traditional inks and have a low percentage of volatile substances, the heat produced causes a sharp increase in temperature, making it necessary to adopt cooling systems in order to remove the heat and prevent high ink temperatures which could compromise the print process. This is especially true of EB-type inks, due to the fact that, when these exceed a certain temperature (around 30° C.), they quickly deteriorate and are no longer usable.

In some known solutions, these cooling systems are basically constituted by a central refrigeration unit that supplies, by means of a pump, cold water under pressure, to each of the sleeve rollers.

Current cooling systems are not very effective in controlling the temperature when using sleeve rollers, because anilox sleeves have a low thermal conductivity and, therefore, it is difficult to effectively remove the heat generated by the friction of the doctor blades on the outer surface of the anilox sleeves, especially when using UV and EB inks.

Traditional anilox sleeves are, in fact, constituted by multiple layers, which, beginning at the inside of the sleeves and moving outward, are provided, respectively, by: a fiberglass inner tube of a thickness of around 1.5 mm; a layer of soft rubber, necessary for the pneumatic expansion of the fiberglass to fit the sleeve over the sleeve cylinder and remove it from the latter; an aluminum tube of around 10 mm in thickness, the outer surface of which is provided with a layer of ceramic of a few tenths of a millimeter, which is laser-cut to form the cells which are of variable sizes and shapes as a function of the inking desired.

Because some of the materials used to make anilox sleeves have a low thermal conductivity, traditional cooling systems exhibit the drawback of performing a temperature control that is considerably slow and, therefore, inadequate for the specific requirements of flexographic machines.

Moreover, also because of the low thermal conductivity of the sleeves, current cooling systems have to operate with a large difference in temperature with respect to the outer surface of the sleeve and consequently they are not very efficient in terms of energy.

Another disadvantage of current cooling systems consists in that they are capable of controlling the temperature of the anilox roller only through cooling and not through heating as well.

SUMMARY OF THE INVENTION

The aim of the present invention is to provide a solution to the above-mentioned problems, by providing an anilox roller, particularly for flexographic printing machines, that is capable of ensuring effective control of the temperature of the anilox roller during the inking operations.

Within this aim, an object of the invention is to provide an anilox roller that makes it possible to achieve a very quick temperature control of the anilox surface, working with relatively small temperature differences.

Another object of the present invention is to provide an anilox roller that makes it possible to prevent inks of the EB type or of the UV type from deteriorating as a result of certain limit temperatures being exceeded and which, moreover, makes it possible to keep the viscosity of the inks that are used constant.

Another object of the invention is to provide an anilox roller that can be easily implemented using elements and materials that are readily available on the market and which, moreover, is low-cost so as to be competitive from a purely economical viewpoint as well.

This aim and these and other objects which will become more apparent hereinafter, are achieved by an anilox roller, particularly for flexographic printing machines, according to the invention, which comprises a sleeve cylinder, rotatably supported about its own axis by the fixed structure of a flexographic printing machine, and an anilox sleeve, which has a tubular body provided, on its outer side wall, with an anilox surface which can be axially fitted on and removed from said sleeve cylinder, and is characterized in that it comprises means for the forced circulation of a temperature control fluid within said tubular body.

BRIEF DESCRIPTION OF THE DRAWINGS

Further characteristics and advantages of the invention will become better apparent from the description of a preferred, but not exclusive, embodiment of the anilox roller, according to the invention, which is illustrated for the purposes of non-limiting example in the accompanying drawings wherein.

DESCRIPTION OF THE PREFERRED EMBODIMENTS

Figure 1:
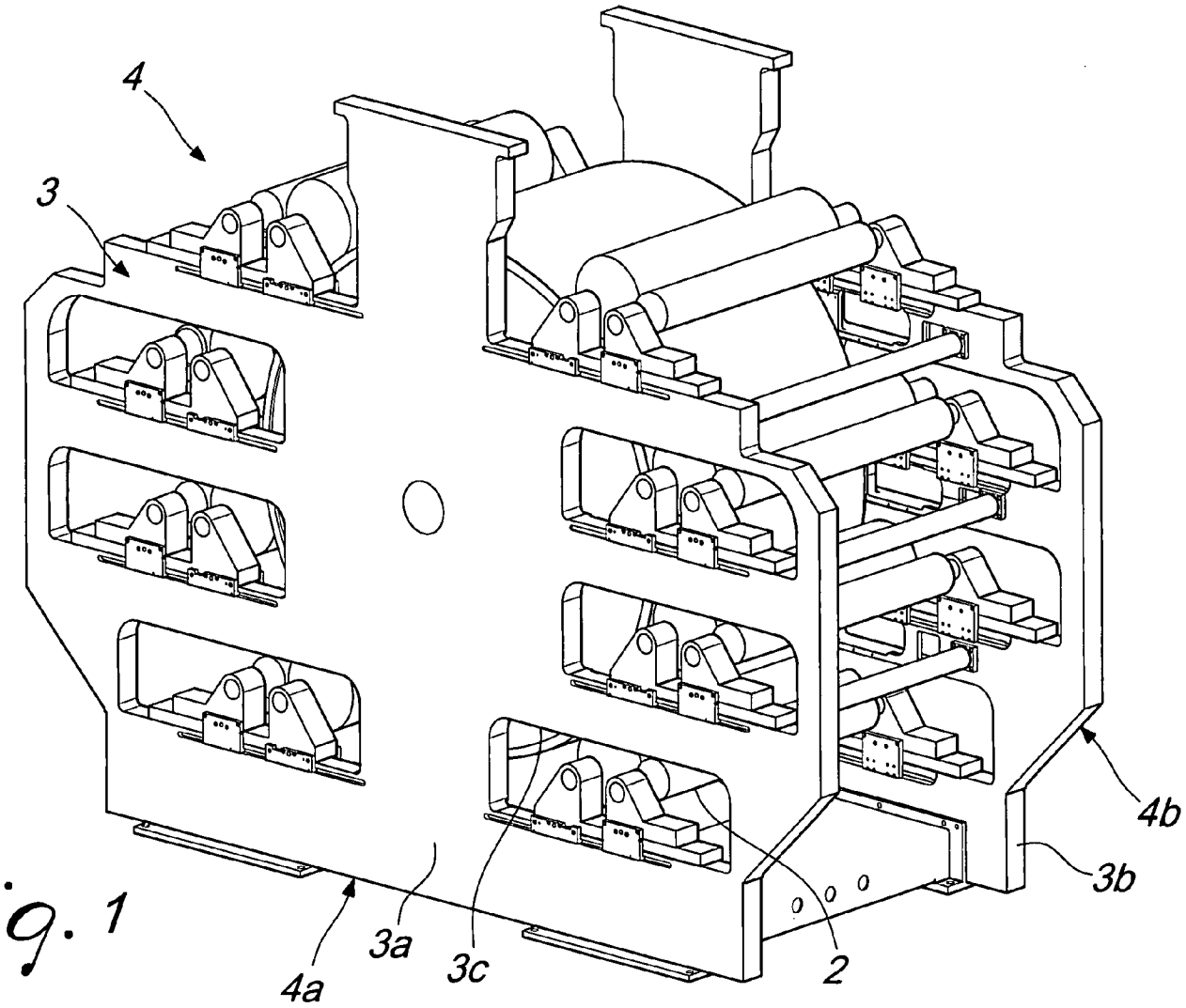
FIG. 1 is a perspective view of a flexographic printing machine to which the anilox roller according to the invention can be applied.

With reference to the figures, an anilox roller, particularly for flexographic printing machines, generally designated with the reference numeral 1, comprises a sleeve cylinder 2, which is rotatably supported, about its own axis, by the fixed structure 3 of a flexographic printing machine 4.

As is the norm, the flexographic printing machine 4 is, conveniently, provided with a front side 4*a*, from which the operators can access the sleeve cylinder 2, and a rear side 4*b*, opposite to the front side.

Preferably, the fixed structure 3 of the flexographic printing machine 4 comprises a first support shoulder 3*a* and a second support shoulder 3*b*, which are substantially parallel to each other and mutually spaced apart along the axis of the sleeve cylinder 2. More specifically, the first support shoulder 3*a* is arranged at the front side 4*a* of the flexographic printing machine 4 and is, conveniently, provided with at least one opening 3*c* for access to the sleeve cylinder 2, while the second support shoulder 3*b* is arranged at the rear side 4*b* of the flexographic printing machine 4. An anilox sleeve 5 can be axially fitted on and removed from the sleeve cylinder 2, and has a tubular body 6 which is provided, on its outer side wall, with an anilox surface 5*a*.

The peculiarity of the invention consists in that it is provided with means for the forced circulation of a temperature control fluid inside the tubular body 6.

Conveniently, these forced circulation means comprise at least one circulation channel 7 into which the temperature control fluid is conveyed, which can be, for example, constituted by water.

More specifically, the circulation channel 7 extends within the thickness of the tubular body 6 and can be detachably connected in input to supply means 8, the function of which is to introduce the temperature control fluid into the circulation duct 7.

For example, the supply means 8 can comprise a pump 10, which, with its delivery outlet, can be connected, detachably, to the inlet of the circulation channel 7.

Advantageously, the circulation channel 7 can, moreover, be detachably connected in output to a heating or cooling unit 9 of the temperature control fluid, the function of which is to bring the temperature control fluid to a preset temperature value.

The heating or cooling unit 9 is connected, in turn, with its outlet, to the supply means 8, which then reintroduce the temperature control fluid exiting from the heating or cooling unit 9 into the circulation duct 7.

Preferably, at least one portion of the circulation channel 7 extends in a spiral about the axis of the tubular body 6.

Figure 2:
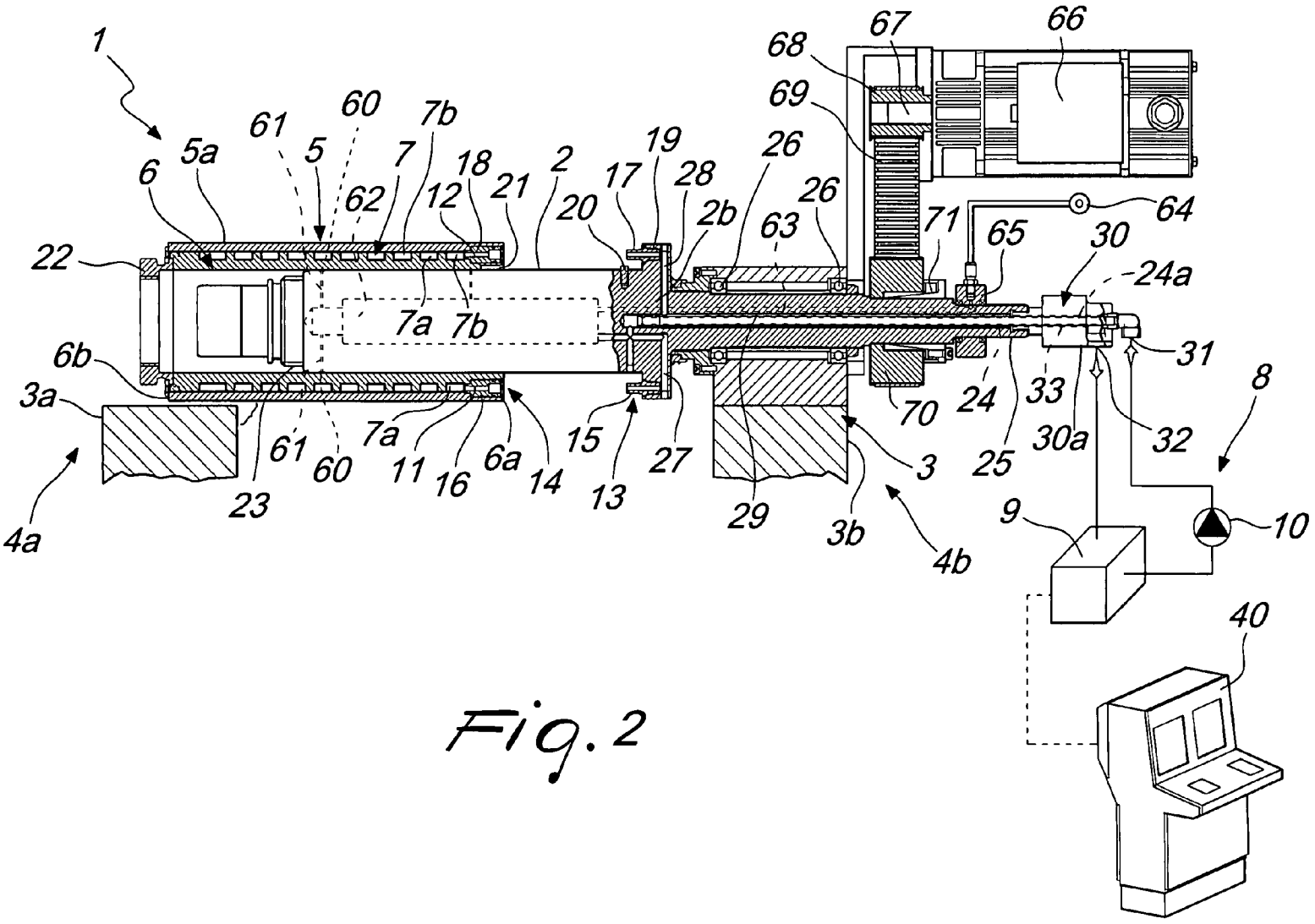
FIG. 2 is a schematic longitudinal sectional view of the anilox roller according to the invention with the anilox sleeve partially removed from the sleeve cylinder.
Figure 3:
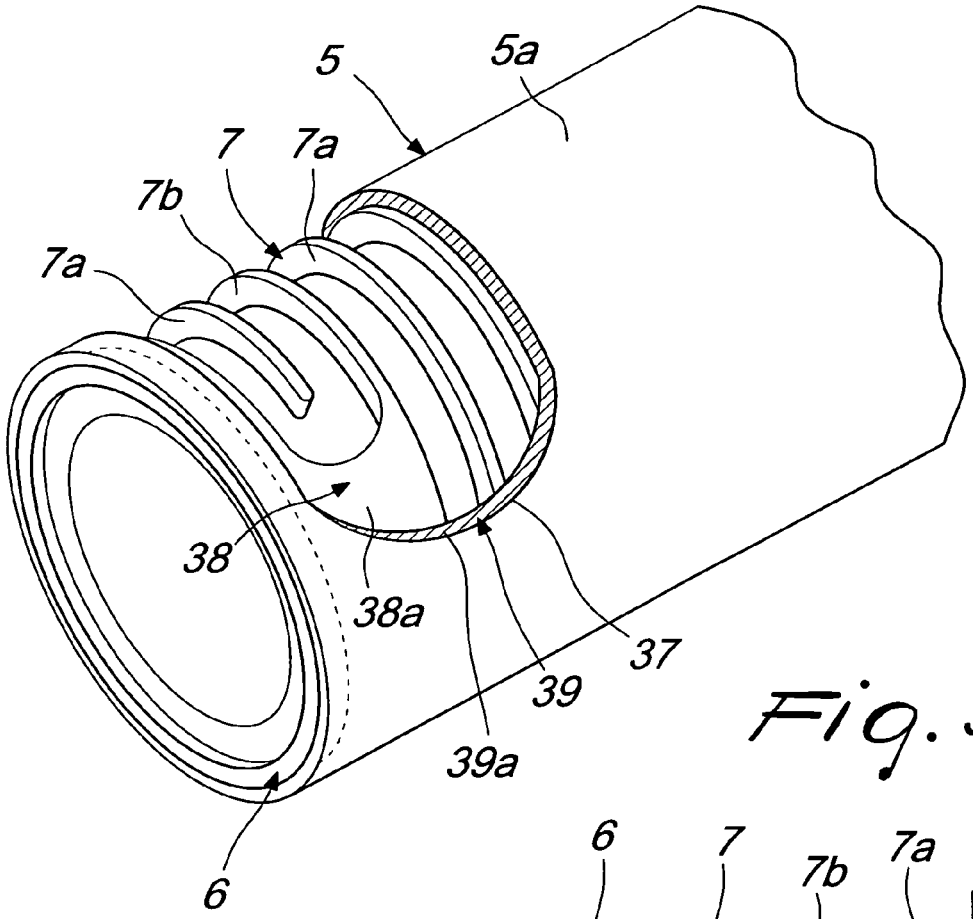
FIG. 3 is a partially cutaway perspective view of a part of the anilox sleeve of the anilox roller according to the invention.
Figure 4:
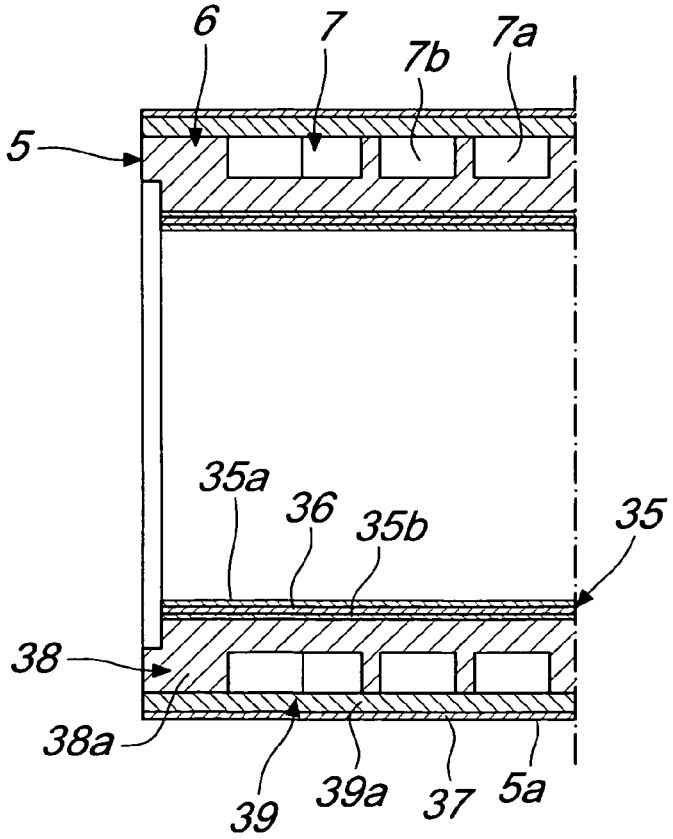
FIG. 4 is a longitudinal sectional partial view of the anilox sleeve of the anilox roller according to the invention.

In particular, with reference to FIGS. 2, 3 and 4, the circulation channel 7 comprises a delivery portion 7*a* and a return portion 7*b* which are mutually connected.

More specifically, the delivery portion 7*a* is provided, conveniently, with an intake port 11, which can be connected detachably and hermetically to the supply means 8 and which is, advantageously, arranged substantially at a first end 6*a* of the tubular body 6.

From its intake port 11, the delivery portion 7*a* extends toward a second end 6*b* of the tubular body 6, opposite to the above-mentioned first end 6*a*, where it joins the return portion 7*b*.

The return portion 7*b* of the circulation channel 7 extends, in turn, from the second end 6*b* of the tubular body 6 toward the first end of the tubular body 6, to flow into a discharge port 12 that is, in fact, arranged substantially at the first end 6*a* of the tubular body 6.

Advantageously, both the delivery portion 7*a* and the return portion 7*b* extend, at least partially, in a spiral about the axis of the tubular body 6.

In particular, conveniently, the turns of the return portion 7*b* are interleaved between the turns of the delivery portion 7*a*.

It should be noted that with this arrangement, an excellent uniformity of temperature is obtained on the outer lateral surface of the anilox sleeve 5, since the temperature control fluid, by absorbing the heat generated by the friction of the doctor blades on the tubular body 6, will tend to progressively heat up as it travels through the delivery portion 7*a*, reaching, in proximity to the second end 6*b* of the tubular body 6, a slightly higher temperature than that which it had at the intake port 11, and it will continue to heat up, further absorbing heat, on its path inside the return portion 7*b*, until it reaches its maximum temperature at the discharge port 12. As a consequence, the outer surface of the anilox sleeve 5 will have, in every region thereof, a temperature that is the average of the various different temperatures of the temperature control fluid in the mutually interleaved spirals of the delivery portion 7*a* and of the return portion 7*b*.

Advantageously, at least between the circulation channel 7 and the supply means 8, removable means for quick hermetic connection are provided which make it possible to connect the circulation channel 7 with the supply means 8 of the temperature control fluid, when the tubular body 6 is fitted over the sleeve cylinder 2.

Specifically, these hermetic quick connection means comprise, conveniently, at least one male quick coupling 13, which is supported by the sleeve cylinder 2 and can hermetically engage in a corresponding female quick coupling 14, which is supported by the tubular body 6 and is connected with the circulation channel 7.

More preferably, at least one first male quick coupling 15 is provided, which is connected to the supply means 8 and can engage detachably and hermetically in a corresponding first female quick coupling 16, located at the intake port 11 of the circulation channel 7, and at least one second male quick coupling 17, which is can be connected to the heating or cooling unit 9 of the temperature control fluid and engage detachably and hermetically in a corresponding second female quick coupling 18, which is fixed to the tubular body 6 and located at the discharge port 12 of the circulation channel 7.

Advantageously, both the first female quick coupling 16 and the second female quick coupling 18 are embedded in the thickness of the tubular body 6 and have elastically yielding internal walls, so as to ensure the perfect seal with the outer surface of the first male quick coupling 15 and of the second male quick coupling 17, respectively.

In the embodiment shown, the first male quick coupling 15 and the second male quick coupling 17 are, advantageously, arranged so as to be mutually angularly spaced about the axis of the sleeve cylinder 2, on an annular shoulder 19, which protrudes radially from the end of the sleeve cylinder 2 that is directed toward the rear side of the flexographic printing machine 4 and which can be engaged by resting contact by the first end 6*a* of the tubular body 6.

Advantageously, in proximity to the annular shoulder 19 there can be a reference pin 20, which protrudes radially from the lateral surface of the sleeve cylinder 2 and can engage an abutment seat 21 formed on the inner side of the tubular body 6, substantially at its first end 6*a*, so as to ensure the correct positioning of the tubular body 6 on the sleeve cylinder 2.

Conveniently, the tubular body 6 is, moreover, provided with removable means of locking to the sleeve cylinder 2.

According to a possible embodiment shown in FIG. 2, these removable locking means are constituted by a locking ferrule 22, which is, for example, located at the second end 6*b* of the tubular body 6 and can rotate, about its own axis, with respect to the tubular body 6, so as to be capable of being screwed onto a threaded portion 23 formed at the end of the sleeve cylinder 2 that is directed toward the front side 4*a* of the flexographic machine 4, so as to ensure, by means of its fastening, a perfect connection of the first male quick coupling 15 with the first female quick coupling 16 and of the second male quick coupling 17 with the second female quick coupling 18, as well.

For example, the locking ferrule 22 is associated with the tubular body 6 by means of a retainer ring 22*a*, which is fixed to the second end 6*b* of the tubular body 6 by means of axial bolts 22*b* and engages a circular prominence 22*c* that juts outward from the locking ferrule 22.

Figure 7:
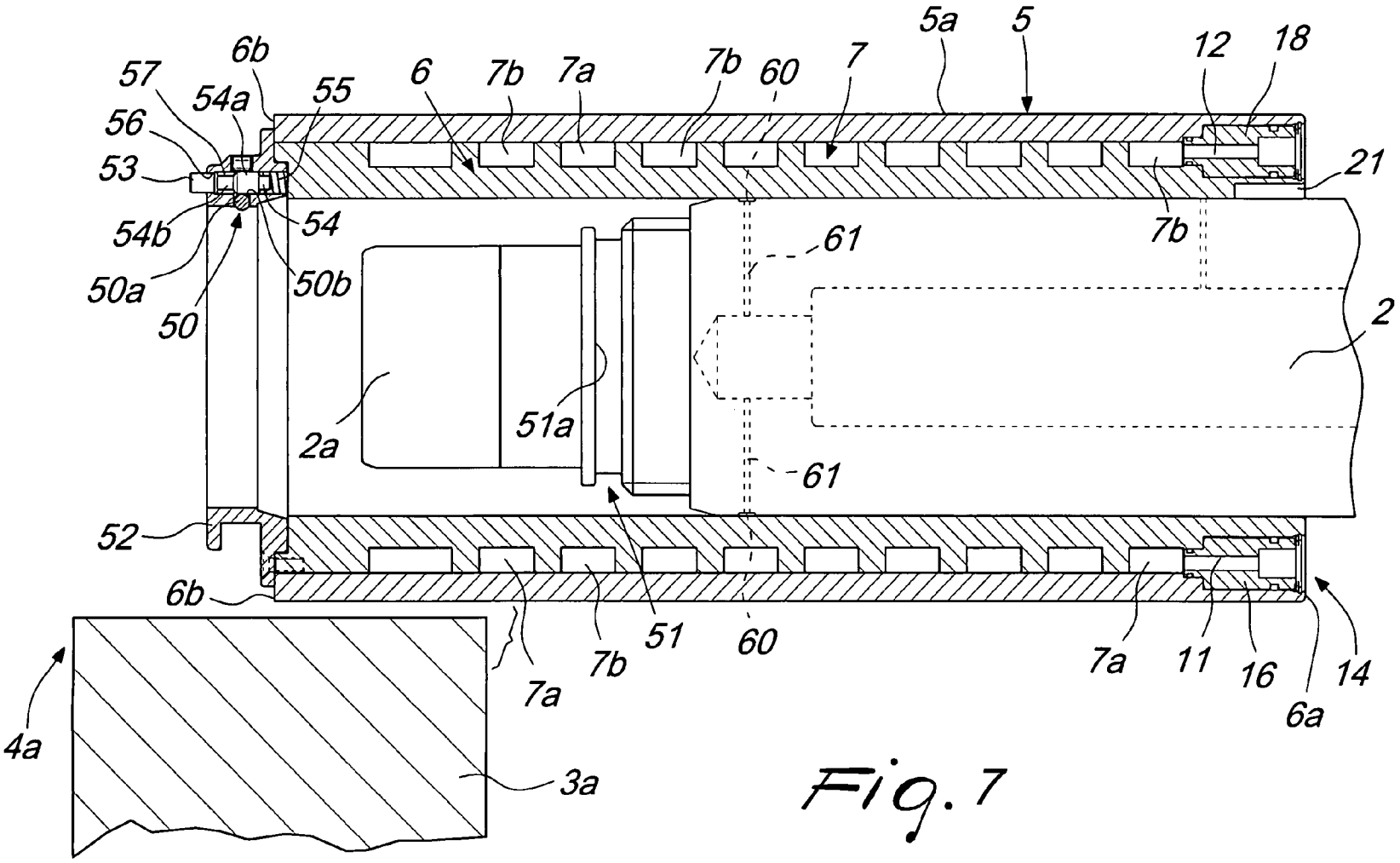
FIG. 7 is a longitudinal sectional view of a variation of embodiment of the means for locking the tubular body of the anilox sleeve to the sleeve cylinder.

With reference to FIG. 7, according to a possible variation of embodiment, the means for removable locking of the tubular body 6 to the sleeve cylinder 2 can be, optionally, implemented with means for quick fastening/release of the tubular body 6 to/from the sleeve cylinder 2.

More specifically, the removable locking means comprise, in this case, at least one engagement element 50, which is associated with the tubular body 6 and can be detachably coupled in a retainer seat 51 formed on the sleeve cylinder 2.

Conveniently, the engagement element 50 is mounted on the inner surface of a support ring 52 which is connected to the second end 6*b* of the tubular body 6 and is substantially coaxial with the tubular body 6.

The retainer seat 51 is, advantageously, constituted by a circumferential engagement groove 51*a* formed on the outer lateral surface of an end portion 2*a* of the sleeve cylinder 2 arranged at the end of the sleeve cylinder 2 that is directed toward the front side 4*a* of the flexographic machine 4.

In particular, the engagement element 50 is constituted, for example, by a ball 50*a*, mounted in an accommodation seat 50*b* formed in the support ring 52, and is movable on command from a locking position, in which it protrudes, with at least one portion thereof, from the inner surface of the support ring 52, and a releasing position, in which it is retracted into the support ring 52.

The passage of the engagement element 50 between the locking position and the releasing position can be, conveniently, commanded via a button 53 which is, advantageously, accessible from the face of the support ring 52 that is directed toward the front side 4*a* of the flexographic machine 4.

For example, the button 53 is constituted by a pin 54 that can perform a translational movement, in contrast with elastic means of recall 55, along a sliding seat 56, that extends substantially parallel to the axis of the support ring 52 and which intersects the accommodation seat 50*b* of the ball 50*a*. The pin 54 is provided, along its longitudinal extension, with a locking section 54*a* and a disengagement section 54*b*, which is provided, laterally, with an indentation 57.

With this arrangement, by manually actuating the button 53 against the action of the elastic means of recall 55, it is possible to axially move, along the sliding seat 56, the pin 54 from a first condition, in which it engages, with its locking section 54*a*, the ball 50*a*, in such a way as to keep it in the locking position, to a second condition, in which the pin 54 is arranged with the indentation 57 at the accommodation seat 50*b* of the ball 50*a*, in such a way as to allow the ball 50*a* to be brought to the releasing position.

In essence, by keeping the button 53 pressed, it is possible to slip the tubular body 6 onto the sleeve cylinder 2, until the support ring 52 is fitted over the end portion 2*a* of the sleeve cylinder 2. Then, by releasing the button 53, it is possible to axially lock the tubular body 6 to the sleeve cylinder 2, by the engagement of the ball 50*a* with the circumferential engagement groove 51*a*. In order to release the support ring 52 from the end portion 2*a* of the sleeve cylinder 2, so as to be able to take the tubular body 6 off the sleeve cylinder 2, all that is needed is to press the button 53, so as to bring the indentation 57 of the pin 54 to the ball 50*a*, thus making it possible for the ball 50*a* to be disengaged from the circumferential engagement groove 51*a*.

As shown in the figures, the supply means 8, conveniently, can be connected to a duct 24 for conveying the temperature control fluid, which axially crosses a supporting shaft 25, which is arranged in axial alignment with the sleeve cylinder 2 and is rigidly connected, at one of its ends, to the end 2*b* of the sleeve cylinder 2 that is directed toward the rear side 4*b* of the flexographic printing machine 4, so as to provide, in essence, an axial extension of the sleeve cylinder 2.

In particular, the supporting shaft 25 is mounted rotatably, with an intermediate portion thereof, on the fixed structure 3 of the flexographic printing machine 4. More precisely, with reference to the embodiment shown in FIG. 2, the supporting shaft 25 is rotatably supported by the second support shoulder 3*b*, for example by means of the interposition of adapted ball bearings 26.

The conveyance duct 24 is, conveniently, connected to the first male quick coupling 15 by means of a first radial distribution channel 27 which is formed inside the sleeve cylinder 2.

As illustrated, the second male quick coupling 17 is, in turn, advantageously connected to a second radial distribution channel 28, which is also formed inside the sleeve cylinder 2.

In particular, the second radial distribution channel 28 flows into a collection channel 29, which is formed inside the supporting shaft 25 and is coaxial with the conveyance duct 24.

Conveniently, the conveyance duct 24 is connected to the supply means 8 through a rotary coupling 30, provided with a connecting body 30*a*, which is integral with the fixed structure 3 of the flexographic printing machine 4 and is axially coupled, so that it can rotate, to the end of the supporting shaft 25 that lies opposite to the end connected to the sleeve cylinder 2.

More precisely, the connecting body 30*a* is provided with an inlet 31, which can be detachably connected to the supply means 8 and is connected with the conveyance duct 24, which, with a portion 24*a* thereof, extends, conveniently, inside the connecting body 30*a*.

On the connecting body 30*a*, moreover, an outlet 32 is provided that can be connected to the heating or cooling unit 9 of the temperature control fluid and is connected with the collection channel 29, through a connection channel 33, formed inside the connecting body 30*a* and coaxially with the portion 24*a* of the conveyance duct 24.

Turning now to FIG. 4, it can be seen that the tubular body 6 is provided, preferably, with a support layer 35, which comprises, conveniently, at least one layer of fiberglass, having, for example, a thickness of around 1.5 mm.

Advantageously, the support layer 35 is, likewise, provided with at least one elastically yielding layer 36, which is, conveniently, made of foam rubber, and which allows the radial expansion of the support layer 35, so as to be able to easily fit the anilox sleeve 5 over the sleeve cylinder 2 and remove it from the same.

More preferably, the support layer 35 is formed by a pair of layers of fiberglass 35*a* and 35*b*, between which the elastically yielding layer 36 is interposed.

Conveniently, on the outer shell of the tubular body 6, a layer of ceramic 37 is provided, which has, preferably, a thickness of a few tenths of a millimeter and is laser-cut to form the cells that make up the anilox surface. As usual, the size and shape of the cells is a function of the inking desired.

Advantageously, the tubular body 6 comprises, moreover, at least one layer with high thermal conductivity, which is crossed, internally, by the circulation duct 7 and, more precisely, in the example illustrated, by the delivery portion 7*a* and by the return portion 7*b* of the circulation duct 7.

In particular, in the embodiment shown, this layer with high thermal conductivity is, in essence, formed by a first layer with high thermal conductivity 38 and by a second layer with high thermal conductivity 39, which are arranged coaxially, one on top of the other, preferably between the elastically yielding layer 36 and the layer of ceramic 37.

Conveniently, the delivery portion 7*a* and the return portion 7*b* of the circulation duct 7 can be formed, partially, in the first layer with high thermal conductivity 38 and, partially, in the second layer with high thermal conductivity 39 or they can be entirely provided in the first layer with high thermal conductivity 38, as shown in the figures, or entirely in the second layer with high thermal conductivity 39.

Descending further into detail, the first layer with high thermal conductivity 38 and the second layer with high thermal conductivity 39 are made of a material that has a high thermal conductivity, such as, for example, aluminum or another metal with similar conductivity characteristics.

In particular, the first layer with high thermal conductivity 38 and the second layer with high thermal conductivity 39 are, preferably, obtained, respectively, by means of a first tube of aluminum 38*a*, arranged coaxially with and inside a second tube of aluminum 39*a*.

With reference to the embodiment in FIGS. 3 and 4, the outer lateral surface of the first aluminum tube 38*a* is provided with two spiral grooves which are designed respectively to provide the delivery portion 7*a* and the return portion 7*b* of the circulation duct 7.

For example, the spiral grooves of the first aluminum tube 38*a* can be obtained by machining with one or more milling cutters on a digitally controlled lathe.

Preferably, the coupling between the first aluminum tube 38*a* and the second aluminum tube 39*a* is obtained by heating the second aluminum tube 39*a*, so as to cause its dilation, and subsequently fitting the second aluminum tube 39*a* over the first aluminum tube 38*a* by interference, so as to ensure an excellent watertight seal between the first and second aluminum tubes 38*a* and 39*a*.

The total thickness of the first layer with high thermal conductivity 38 and of the second layer with high thermal conductivity 39 is, preferably, around 25 mm, so as to allow the possibility of embedding the first and the second female quick coupling 16 and 18 in it.

According to a preferred embodiment, the heating or cooling unit 9 can schematically comprise: a refrigeration unit, the function of which is to cool the temperature control fluid, one or more modulating valves, the function of which is to control the flow of the temperature control fluid that is sent to the anilox sleeve 5, and one or more electric resistors or heat exchangers, the function of which is to intervene to optionally heat the temperature control fluid.

Advantageously, the heating or cooling unit 9 can be driven by means of a control unit 40, provided with a thermostat device, that enables the operator to set the desired temperature of the anilox sleeve 5.

Advantageously, the control unit 40 is functionally connected to temperature sensors adapted to detect, at various points, the temperature of the ink which is applied to the anilox sleeve 5, during the operation of the flexographic printing machine 4.

In particular, at least one first temperature sensor 41 is provided which is adapted to measure the value of the temperature of the ink flowing out from the inking chamber 42 formed in the traditional closed chamber doctor blade 43 that is placed, in a way that is known per se, against the sleeve cylinder 2 in the flexographic printing machine 4.

Conveniently, a second temperature sensor 44 can also be provided which is adapted to detect the temperature of the ink that can be withdrawn from a collection tank 45 in order to be sent to the inking chamber 42.

In this way, the control unit 40 can command the activation of the heating or cooling unit 9 according to the signals coming from the first and second temperature sensors 41 and 44.

Figure 5:
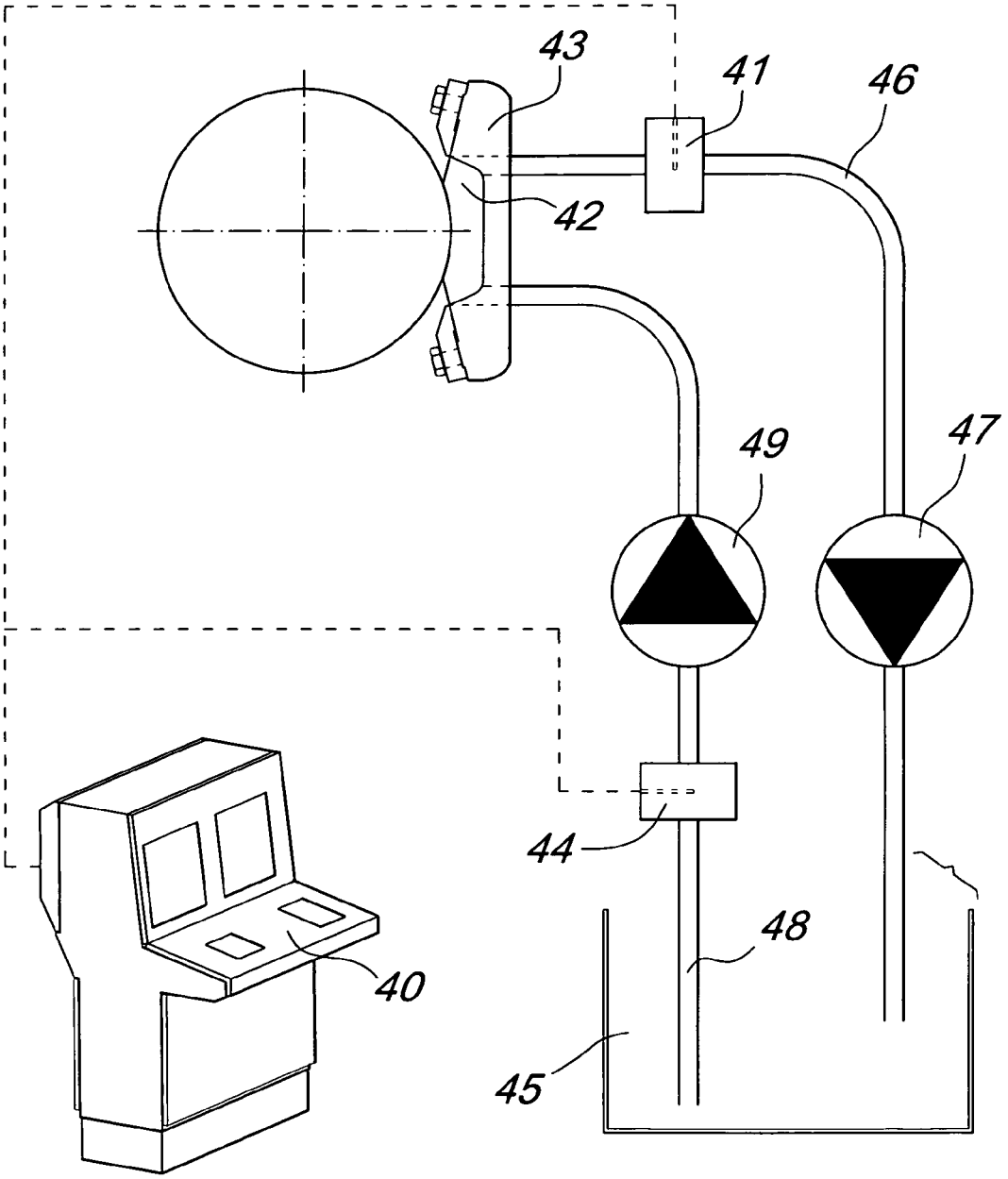
FIG. 5 is a diagram of an inking system that can be associated with the anilox roller according to the invention.
Figure 6:
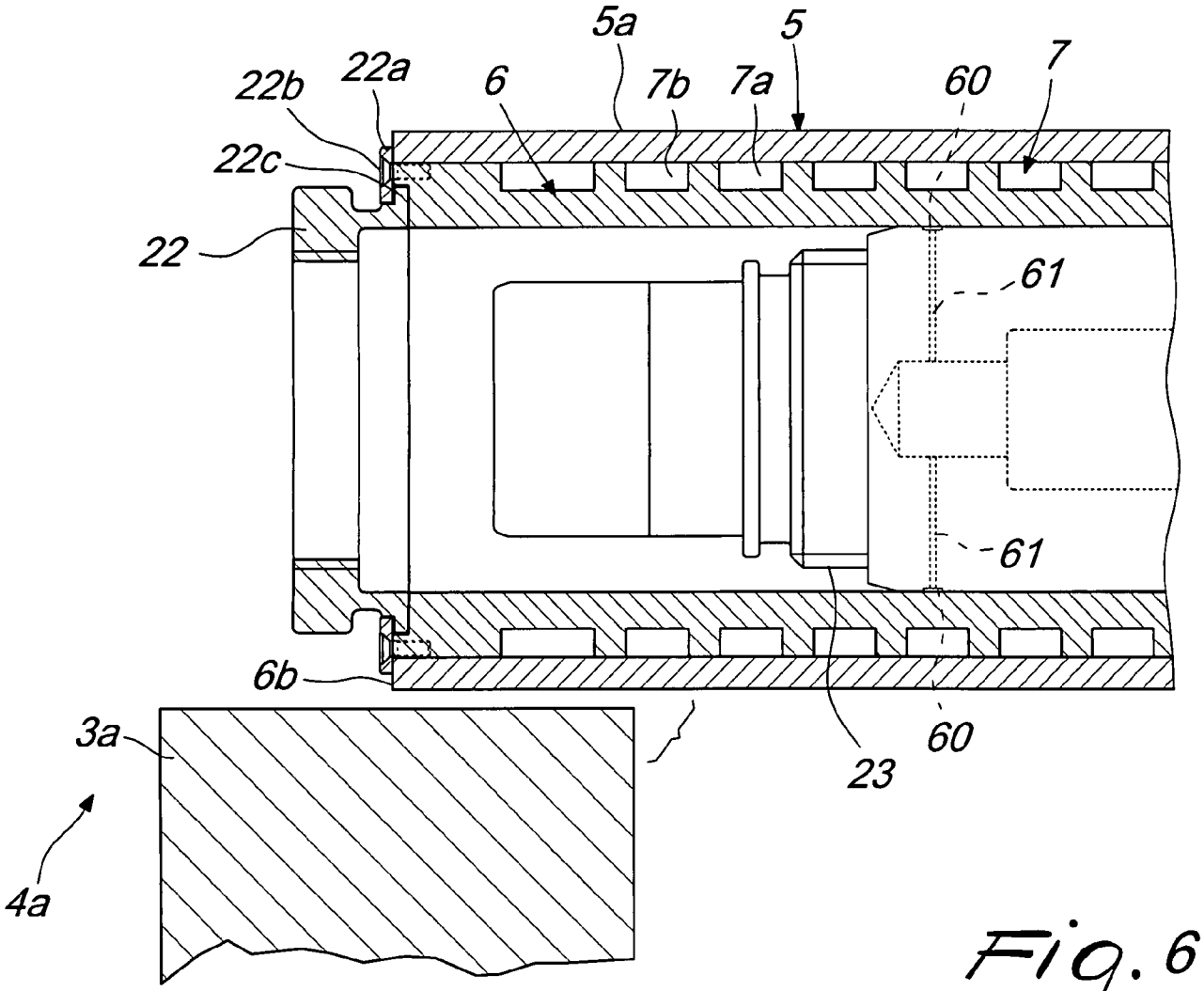
FIG. 6 is an enlarged-scale view of a detail of FIG. 2.

As shown schematically in FIG. 5, the first temperature sensor can be, for example, interposed along a return duct 46, which, by means of a first ink circulation pump 47, makes it possible to send the ink from the inking chamber to the collection tank 45, whereas the second temperature sensor 44 can be interposed along a delivery duct 48, which, by means of a second ink circulation pump 49, is capable of drawing ink from the collection tank 45 in order to inject it into the inking chamber 42.

For the sake of completeness, it should be noted that the sleeve cylinder 2 is provided, advantageously, with pneumatic means of expanding the tubular body 6, which make it possible to easily fit the anilox sleeve 5 over the sleeve cylinder 2 and remove it from the same.

In the embodiment shown, these pneumatic expansion means comprise a plurality of openings for dispensing 60, which are arranged on the outer side wall of the sleeve cylinder 2 and are adapted to emit pressurized air, so as to cause a radial expansion of the tubular body 6, when fitting the tubular body 6 over, or removing it from, the sleeve cylinder 2.

In particular, these openings for dispensing 60 are connected, by means of channels for dispensing 61, which are formed radially inside the sleeve cylinder 2, to a tank of compressed air 62, which is formed axially with respect to the sleeve cylinder 2 and connected, in turn, to a channel for delivering compressed air 63, which extends, longitudinally, inside the sleeve cylinder 2 and the supporting shaft 25 and can be connected to a compressed air dispenser 64, by means of a rotating header 65, arranged at an intermediate region of the supporting shaft 25.

Advantageously, the actuation in rotation of the sleeve cylinder 2, about its own axis, can be obtained by means of an electric motor 66, which is arranged, with its drive shaft 67, substantially parallel to the sleeve cylinder 2.

More specifically, as illustrated in the example in FIG. 2, a toothed pulley 68 is rigidly mounted on the drive shaft 67 of the electric motor 66 and engages a transmission belt 69 that loops around a driven pulley 70 which is keyed on the supporting shaft 25, for example by means of a conical keying set 71.

The operation of the anilox roller according to the invention is as follows.

The operator fits the anilox sleeve 5 over the sleeve cylinder 2, inserting the first male quick coupling 15 in the first female quick coupling 16 and the second male quick coupling 17 in the second female quick coupling 18. Subsequently, the tubular body 6 of the anilox sleeve 5 is locked onto the sleeve cylinder 2, by tightening of the locking ferrule 22 by screwing it along the threaded portion 23 of the sleeve cylinder 2 or, according to the embodiment in FIG. 7, by proceeding to engage the ball 50*a* provided on the tubular body 6 in the circumferential engagement groove 51*a* provided in the end portion 2*a* of the sleeve cylinder 2.

By means of the control unit 40, the operator sets the temperature value desired on the anilox surface 5*a* of the anilox sleeve 5.

Once the supply means 8 have been activated, the temperature control fluid is caused to circulate in the circulation channel 7, so that it can pass through the delivery portion 7*a* and the return portion 7*b*, until it arrives at the heating or cooling unit 9, where it undergoes a heating or a cooling process according to the temperature value set by the operator.

Upon exit from the heating or cooling unit 9, the temperature control fluid is sent again to the circulation channel 7 by the supply means 8.

In practice it has been found that the invention is capable of fully achieving the set aim and, in particular, attention is drawn to the fact that the anilox roller according to the invention makes it possible to operate the temperature control of the anilox roller very quickly.

Another advantage of the anilox roller according to the invention is that it makes it possible to directly control the temperature of the anilox sleeve.

Moreover, the anilox roller according to the invention has the advantage of being able to control the temperature of the anilox roller with differences in temperature between the inside of the anilox sleeve and its outer surface that are considerably reduced compared with the known art.

Another advantage of the anilox roller according to the invention is that it enables temperature control of the anilox sleeve both during cooling and during heating.

All the characteristics of the invention, indicated above as advantageous, advisable or similar, may also be missing or be substituted by equivalent characteristics.

The individual characteristics set out with reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The disclosures in Italian Patent Application No. VR2010A000171 from which this application claims priority are incorporated herein by reference.

What is claimed is:

1. An anilox roller for inking a plate carried by a plate roller in a flexographic printing machine, the anilox roller comprising:

a sleeve cylinder rotatably supported about an axis thereof by a fixed structure of the flexographic printing machine;

an anilox sleeve, which has a tubular body having a side wall with a thickness thereof and being provided, on an outer part of said side wall, with an anilox surface provided with a plurality of cells in which ink is depositable for transfer to the plate, said anilox sleeve being axially fittable on and removable from said sleeve cylinder;

forced circulation means for providing forced circulation of a temperature control fluid within said tubular body that comprise at least one circulation channel for said temperature control fluid, said at least one circulation channel extending in said tubular body within the thickness of said side wall and comprising a delivery portion provided with an intake port and a return portion provided with a discharge port, said delivery and return portions being mutually connected; and removable quick coupling means for hermetic coupling by engagement, upon fitting of said anilox sleeve on said sleeve cylinder, between respective quick couplings provided at said intake and discharge ports and corresponding quick couplings provided on a shoulder of said sleeve cylinder;

said at least one circulation channel comprising a delivery portion and a return portion which are mutually connected and wind both, at least partially, in a spiral, about the axis of the tubular body, between a first end of said tubular body and a second end of said tubular body, and so that turns of the return portion are interleaved between the turns of the delivery portion, said delivery portion and said return portion being mutually connected at said second end of said tubular body;

said at least one circulation channel is detachably connectable in output to a unit for heating or cooling said temperature control fluid, the output of said heating or cooling unit being connected to supply means of the flexographic printing machine which are adapted to dispense the temperature control fluid, said delivery portion extends from said intake port, which is connectable detachably and hermetically to said supply means and is arranged substantially at said first end of said tubular body, toward said second end of said tubular body, which lies opposite said first end, said return portion extending from said second end of said tubular body and being connected to said discharge port of said temperature control fluid which is arranged substantially at said first end of said tubular body, said supply means being connectable to a conveyance duct for the conveyance of said temperature control fluid, which passes axially through a supporting shaft, which is rigidly connected, at one of its ends, to an end of said sleeve cylinder that is directed toward a rear side of said flexographic printing machine and is mounted rotatably, with an intermediate portion thereof; on the fixed structure of said flexographic printing machine, said conveyance duct being connected to a first male quick coupling through a first radial distribution channel, which is formed and arranged inside said sleeve cylinder at said first end of said tubular body, a second male quick coupling being connected to a second radial distribution channel, which is formed and arranged inside said sleeve cylinder at said first end of said tubular body and merges into a collection channel which is formed in said supporting shaft coaxially to said conveyance duct, wherein said quick couplings comprise said first male quick coupling connected to said supply means and engageable detachably and hermetically in a corresponding first female quick coupling located at said intake port of said circulation channel, and said second male quick coupling, which is connectable to said unit for heating or cooling said temperature control fluid and engageable detachably and hermetically in a corresponding second female quick coupling located at said discharge port of said circulation channel, wherein said first male quick coupling and said second male quick coupling are arranged so as to be mutually angularly spaced, about the axis of said sleeve cylinder, on said shoulder, which is annular and protrudes radially from the end of said sleeve cylinder that is directed toward a rear side of said flexographic printing machine and is engageable by resting contact by tubular body with said first end, wherein said tubular body is provided with means for removable locking to said sleeve cylinder, wherein said removable locking means comprise means for the quick engagement/disengagement of said tubular body with respect to said sleeve cylinder, wherein said first female quick coupling and said second female quick coupling are embedded in the wall thickness of said tubular body and have elastically yielding internal walls, and further comprising pneumatic means for expanding said tubular body for facilitating fitting and removal of said anilox sleeve with respect to said sleeve cylinder.

2. The anilox roller of claim 1, comprising a reference pin, which protrudes substantially at right angles from said annular shoulder and is engageable by an abutment seat formed on said tubular body at said first end.

3. The anilox roller of claim 1, wherein said conveyance duct extends within a connecting body which is coupled axially, through a rotary coupling, to the end of said supporting shaft that lies opposite the end connected to said sleeve cylinder, said connecting body having an inlet in communication with said conveyance duct and is connectable to said supply means, and an outlet communicating with said collection channel and is connectable to said unit for heating or cooling said temperature control fluid.

4. The anilox roller of claim 1, wherein said tubular body comprises at least one layer with high thermal conductivity, which is crossed internally by said circulation duct.

5. An anilox roller for inking a plate carried by a plate roller in a flexographic printing machine, the anilox roller comprising:

a sleeve cylinder rotatably supported about an axis thereof by a fixed structure of the flexographic printing machine;

an anilox sleeve, which has a tubular body having a side wall with a thickness thereof and being provided, on an outer part of said side wall, with an anilox surface provided with a plurality of cells in which ink is depositable for transfer to the plate, said anilox sleeve being axially fittable on and removable from said sleeve cylinder; and forced circulation means for providing forced circulation of a temperature control fluid within said tubular body that comprise at least one circulation channel for said temperature control fluid extending in said tubular body within the thickness of said side wall, wherein said at least one circulation channel comprises a delivery portion and a return portion which are mutually connected and wind both, at least partially, in a spiral, about the axis of the tubular body, between a first end of said tubular body and a second end of said tubular body, and so that turns of the return portion are interleaved between the turns of the delivery portion, said delivery portion and said return portion being mutually connected at said second end of said tubular body, said at least one circulation channel is detachably connectable in output to a unit for heating or cooling said temperature control fluid, the output of said heating or cooling unit being connected to supply means of the flexographic printing machine which are adapted to dispense the temperature control fluid, said delivery portion extending from said intake port, which is connectable detachably and hermetically to said supply means and is arranged substantially at the first end of said tubular body, toward the second end of said tubular body, which lies opposite said first end, said return portion extending from said second end of said tubular body and being connected to said discharge port of said temperature control fluid which is arranged substantially at said first end of said tubular body, said supply means being connectable to a conveyance duct for the conveyance of said temperature control fluid, which passes axially through a supporting shaft, which is rigidly connected, at one of its ends, to an end of said sleeve cylinder that is directed toward a rear side of said flexographic printing machine and is mounted rotatably, with an intermediate portion thereof, on the fixed structure of said flexographic printing machine, said conveyance duct being connected to a first male quick coupling through a first radial distribution channel, which is formed and arranged inside said sleeve cylinder at said first end of said tubular body, a second male quick coupling being connected to a second radial distribution channel, which is formed and arranged inside said sleeve cylinder at said first end of said tubular body and merges into a collection channel which is formed in said supporting shaft coaxially to said conveyance duct, wherein said quick couplings comprise said first male quick coupling connected to said supply means and engageable detachably and hermetically in a corresponding first female quick coupling located at said intake port of said circulation channel, and said second male quick coupling, which is connectable to said unit for heating or cooling said temperature control fluid and engageable detachably and hermetically in a corresponding second female quick coupling located at said discharge port of said circulation channel, wherein said first male quick coupling and said second male quick coupling are arranged so as to be mutually angularly spaced, about the axis of said sleeve cylinder, on said shoulder, which is annular and protrudes radially from the end of said sleeve cylinder that is directed toward a rear side of said flexographic printing machine and is engageable by resting contact by said tubular body with said first end, wherein said tubular body is provided with means for removable locking to said sleeve cylinder, wherein said removable locking means comprise means for the quick engagement/disengagement of said tubular body with respect to said sleeve cylinder, wherein said first female quick coupling and said second female quick coupling are embedded in the wall thickness of said tubular body and have elastically yielding internal walls, and further comprising pneumatic means for expanding said tubular body for facilitating fitting and removal of said anilox sleeve with respect to said sleeve cylinder.

* * * * *